US006234756B1

(12) United States Patent
Ress, Jr. et al.

(10) Patent No.: US 6,234,756 B1
(45) Date of Patent: May 22, 2001

(54) SEGMENTED RING BLADE RETAINER

(75) Inventors: Robert Anthony Ress, Jr., Carmel; Edward Claude Rice, Indianapolis, both of IN (US)

(73) Assignee: Allison Advanced Development Company, Indianapolis, IN (US)

( * ) Notice: Subject to any disclaimer, the term of this patent is extended or adjusted under 35 U.S.C. 154(b) by 0 days.

(21) Appl. No.: 09/179,028

(22) Filed: Oct. 26, 1998

(51) Int. Cl.[7] ..... F01D 5/32

(52) U.S. Cl. ..... 416/220 R; 29/525.02; 403/326

(58) Field of Search ..... 416/220 R, 221, 416/219 R, 248; 29/889.21, 889.22, 525.01, 525.02; 403/326, 328, 155

(56) References Cited

U.S. PATENT DOCUMENTS

| | | | | |
|---|---|---|---|---|
| 3,653,781 | * | 4/1972 | Cooper | 416/221 |
| 4,247,257 | | 1/1981 | Benoist et al. . | |
| 4,275,990 | | 6/1981 | Langley et al. . | |
| 4,730,983 | | 3/1988 | Naudet et al. . | |
| 5,018,941 | | 5/1991 | Heurtel et al. . | |
| 5,211,407 | | 5/1993 | Glynn et al. . | |
| 5,256,035 | | 10/1993 | Norris et al. . | |
| 5,281,098 | * | 1/1994 | Glynn et al. | 416/221 |
| 5,302,086 | | 4/1994 | Kulesa et al. . | |
| 5,320,492 | | 6/1994 | Bouru et al. . | |
| 5,501,575 | | 3/1996 | Eldredge et al. . | |
| 5,660,526 | | 8/1997 | Ress, Jr. . | |
| 5,713,721 | * | 2/1998 | Glynn et al. | 416/220 R |

* cited by examiner

*Primary Examiner*—Edward K. Look
*Assistant Examiner*—Liam McDowell
(74) *Attorney, Agent, or Firm*—Woodard, Emhardt, Naughton, Moriarty & McNett

(57) ABSTRACT

A retainer for a rotor disk assembly of a gas turbine engine forms one aspect of the present invention. The retainer prevents axial displacement of a plurality of blades coupled to the rotor disk. The retainer includes a plurality of retaining segments and a locking segment. The locking segment is positioned between two of the retaining segments to define a first joint and a second joint. The first and second joints are offset a distance from and are substantially parallel to an axis extending through the center of the rotor disk assembly. The retainer may also be provided with means for preventing displacement of the retainer towards the center of the rotor disk assembly.

26 Claims, 8 Drawing Sheets

SEGMENTED RING BLADE RETAINER

This invention was made under U.S. Government Contract No. F33615-92-C-2268. The United States Government may have certain rights under this contract.

BACKGROUND OF THE INVENTION

The present invention relates generally to the design and construction of a lightweight high temperature retainer for a rotor disk assembly. More particularly, the present invention has one form wherein a low-density high temperature segmented ring retainer resists the axial displacement of a gas turbine engine's compressor and turbine blades. Although the present invention was developed for a gas turbine engine, certain applications may be outside this field.

The gas turbine engine is representative of the type of machinery in which the present invention may be advantageously used. A conventional gas turbine engine integrates a compressor and a turbine that have components that rotate at extremely high speeds. The compressor is operable to compress air to the proper pressure required for supporting the combustion of fuel in a combustion chamber. A high temperature gas exiting the combustion chamber provides the working fluid for the turbine, and may also be used to drive a power turbine. The power turbine drives a propeller, fan, or other device. Further, the high temperature gas may be used directly as thrust for providing motive power, such as in a turbine jet engine.

A gas turbine engine rotor assembly conventionally comprises a plurality of circumferentially spaced airfoils, which extend radially outward from a rotor disk. During engine operation, the rotor assembly is rotated at a high speed, thereby creating a centrifugal force acting on the components. Axial forces are imparted to the airfoils as the fluid passes through the rotor assembly.

The rotor assemblies often include a dovetail or firtree attachment mechanism for coupling the components together and resisting the centrifugal force acting on the components. Many prior designs have included axial retaining mechanisms such as rivets, bolts, tangs, pins and split rings to counteract axial loads on the airfoil. The utilization of mechanisms such as rivets, bolts and pins can introduce stress concentration cites which lead to fatigue life limitations. The tang type axial retaining mechanisms generally require additional adjacent structure to provide the necessary restraint in the fore and aft direction.

Split ring retainer systems generally include a retaining hook formed around the periphery of the rotor disk. The split ring retainer is deflected to a size appropriate for insertion into the retaining hook, and upon release is positioned within the retaining hook to resist axial displacement of the airfoils. The split ring retainers have generally been formed from steel or nickel materials so as to have the required strength for load resistance and ductility for deflection.

The high-speed rotation of the rotor assembly causes a centrifugal load associated with the tang type and split ring type retainer that must be carried by the airfoil attachment mechanism. Further, increased compressor pressure ratios require the utilization of retainers having improved temperature capabilities. Thus, it is desirable to incorporate low-density high temperature materials into the airfoil retaining systems. Low-density high temperature materials with the necessary strength for gas turbine engine airfoil retainers generally do not possess the requisite ductility for use in split ring retainers.

Heretofore, there has been a need for a lightweight, high-temperature retaining mechanism for a gas turbine engine rotor assembly. A means for satisfying this need has theretofore escaped those skilled in the art. The present invention satisfies this need in a novel and unobvious way.

SUMMARY OF THE INVENTION

One form of the present invention contemplates a retainer, comprising: a plurality of retaining segments abutting one another and defining a first end and a second end spaced a first distance therefrom; and, a locking segment having a third end and a fourth end that are substantially parallel to one another, the locking segment positioned within the space and at least one of the third end and the fourth end abutting at least one of the first end and the second end.

Another form of the present invention contemplates an apparatus, comprising: at least one blade; a disk for carrying the at least one blade, the disk defining a center and an axis therethrough; a retainer engaged to the at least one blade and the disk, the retainer including a plurality of abutting retaining segments that define a first end and a second end that are parallel to and offset from the axis and a locking segment positioned between and slidingly engaging at least one of the ends.

Yet another form of the present invention contemplates an apparatus, comprising: a gas turbine engine rotor disk having a centerline; a plurality of blades coupled to the rotor disk; a passageway disposed along the rotor disk; a retainer received within the passageway, the retainer engaging the plurality of blades and the disk; wherein the retainer, includes a plurality of abutting retaining segments defining a first end and a second end spaced a first distance and wherein the first and the second ends are substantially parallel, a locking segment positioned between the first and second ends, and engaging at least one of the first and second ends; and at least one first member preventing displacement of the locking segment retainer towards the centerline.

One aspect of the present invention contemplates an apparatus comprising: at least one blade; a disk for carrying the at least one blade, the disk defining a center and an axis therethrough; and, retainer means for preventing axial displacement of at least one blade with respect to the disk.

Another aspect of the present invention contemplates a method for resisting axial displacement of a plurality of blades of a rotor disk assembly of a gas turbine engine, the rotor disk assembly defining a center and an axis extending therethrough and including a retaining hook. The method, comprising: providing a segmented retainer, the segmented retainer including a plurality of retaining segments and at least one locking segment; placing the plurality of retaining segments in the retaining hook, the retaining segments defining a first end and a second end, each offset a distance from and parallel to the axis; and inserting a locking segment between the first end and the second end.

One object of the present invention is to provide an improved retainer for a gas turbine engine rotor assembly.

Related objects and advantages of the present invention will be apparent from the following description.

DESCRIPTION OF THE PREFERRED EMBODIMENTS

Figure 1:
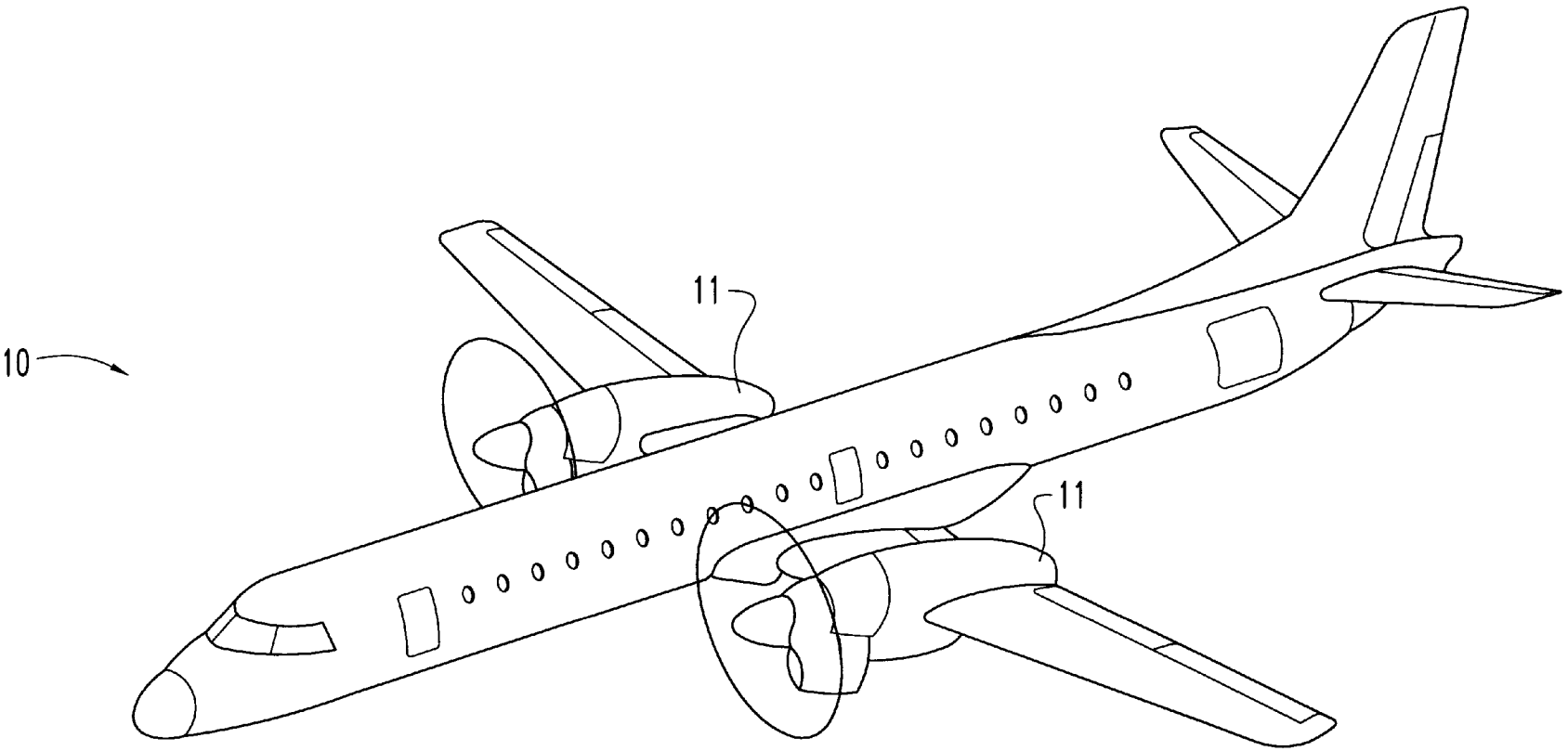
FIG. 1 is a perspective view of an aircraft having a gas turbine engine connected thereto.

For the purposes of promoting an understanding of the principals of the invention, reference will now be made to the embodiment illustrated in the drawings and specific language will be used to describe the same. It will, nevertheless, be understood that no limitation of the scope of the invention is thereby intended, and such alterations and further modifications of the illustrated device, and such further applications of the principals of the invention as illustrated therein being contemplated as would normally occur to one skilled in the art to which the invention relates.

Figure 2:
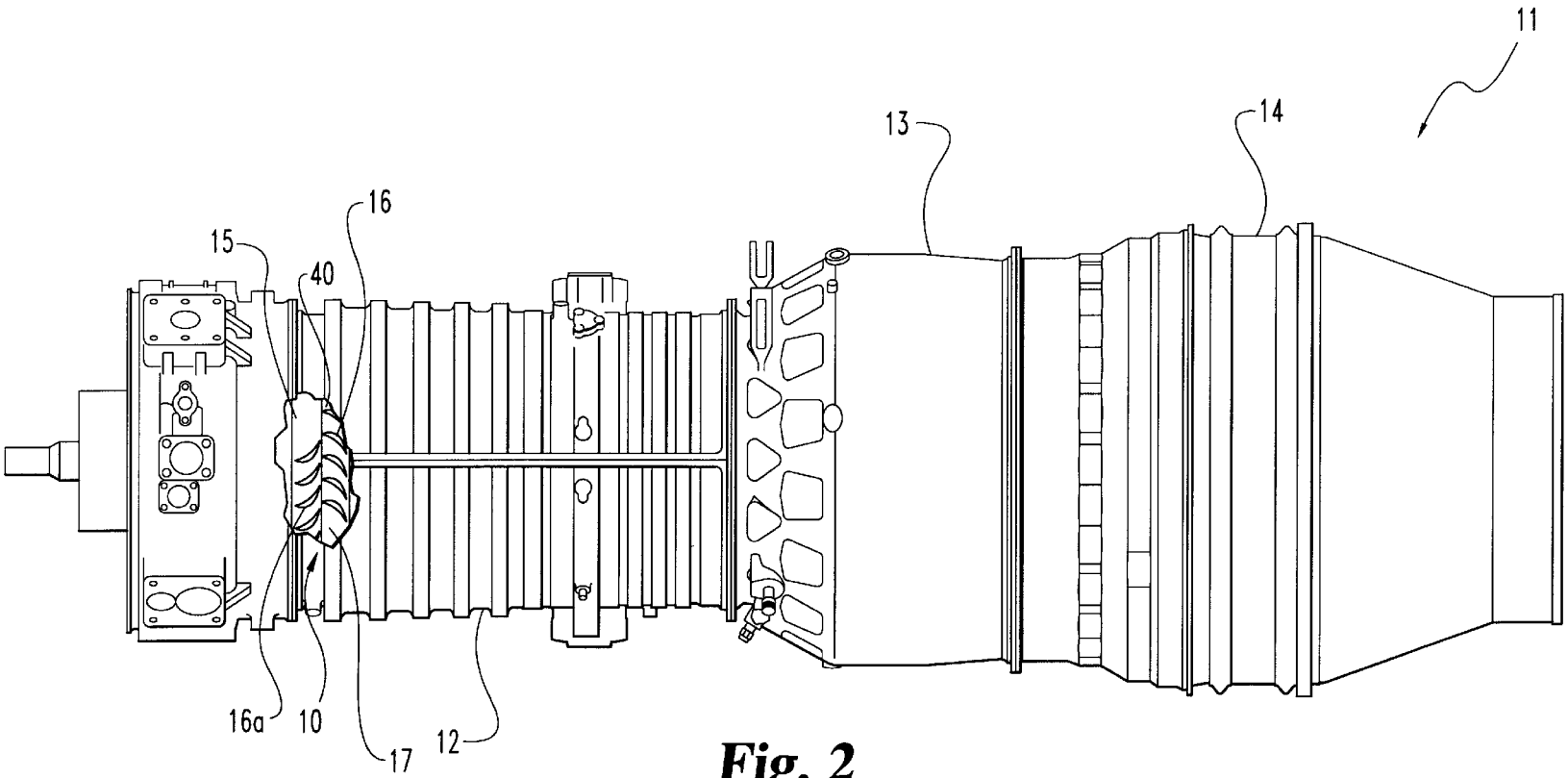
FIG. 2 is an enlarged partially fragmented side elevational view of the gas turbine engine of FIG. 1.

Referring to FIGS. 1 and 2, there is illustrated an aircraft 10 having an aircraft flight propulsion engine 11. It is understood that an aircraft is generic and includes helicopters, tactical fighters, trainers, missiles, and other apparatus. In one embodiment, the flight propulsion engine 11 includes a compressor 12, a combustor 13, and a turbine 14. It is important to realize that there is a multitude of ways in which the components can be linked together. Additional compressors and turbines may be added with intercoolers connecting between the compressors, and reheat combustor chambers could be added between the turbines. Further, the gas turbine engine is equally suited to be used for industrial application. Historically, there has been widespread application of industrial gas turbine engines, such as pumping sets for gas and oil transmission lines, electricity generation, and naval propulsion.

Referring back to FIG. 2, there is illustrated an enlarged partially fragmented view of the gas turbine engine 11 having a rotor assembly 40 therein. The rotor assembly 40 includes a plurality of compressor blades 16 that are coupled to a rotor disk portion 17. Rotor disk 17 is affixed to a tubular shaft (not illustrated) within the gas turbine engine 11. The rotor assembly 40 is rotatable within a mechanical housing defining a portion of the gas turbine engine 11. A plurality of vanes 16*a* directs the incoming fluid stream to the rotor assembly 40. In one embodiment, the plurality of vanes 16*a* form a nozzle. While the rotor assembly 40 has been disclosed for a compressor, an analogous rotor assembly is applicable to the turbine 14. Further, the term airfoil will be used herein, unless specifically stated otherwise, to refer to a blade.

Figure 3:
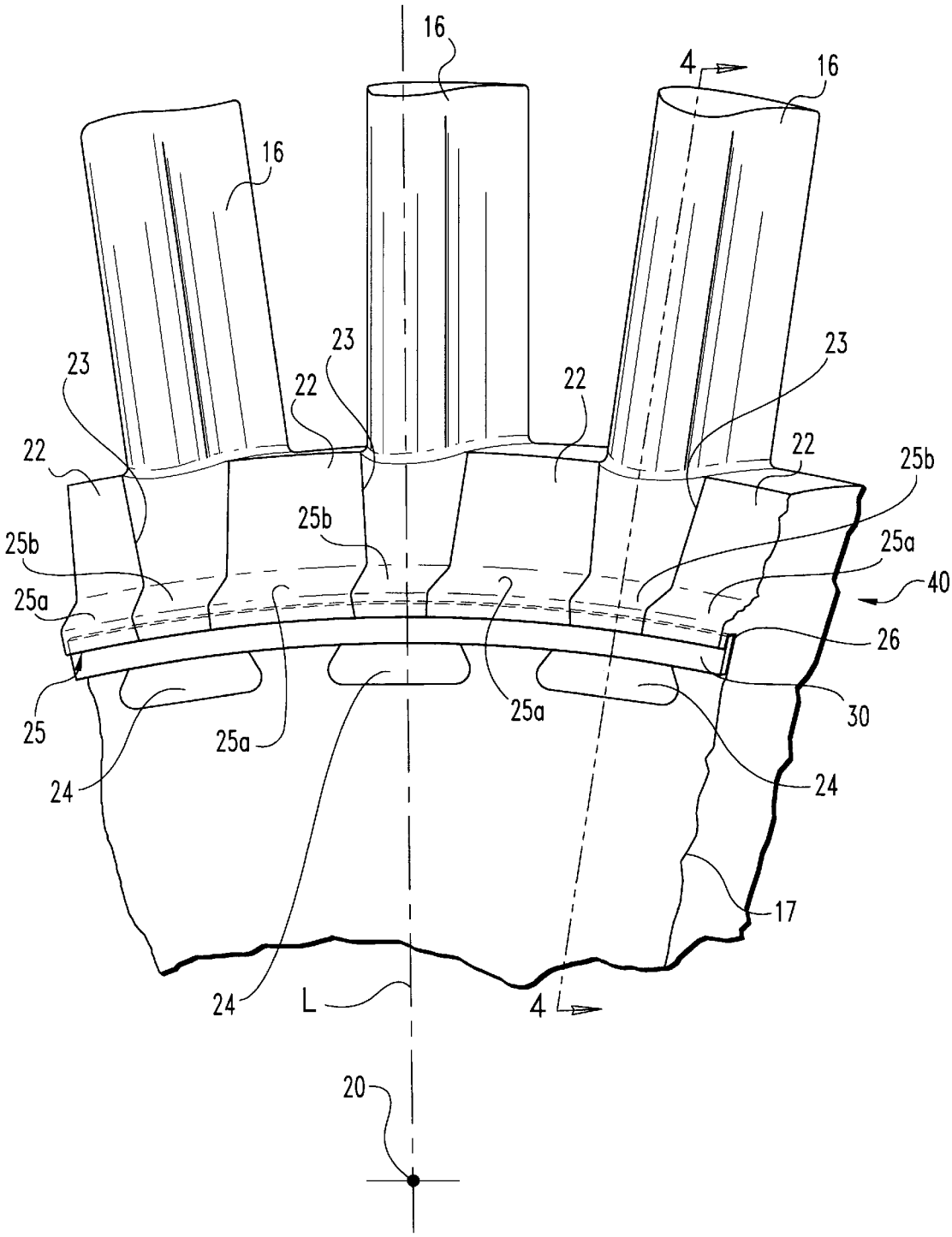
FIG. 3 is an illustrative partial side elevational view of a rotor assembly comprising a portion of the gas turbine engine of FIG. 2.
Figure 4:
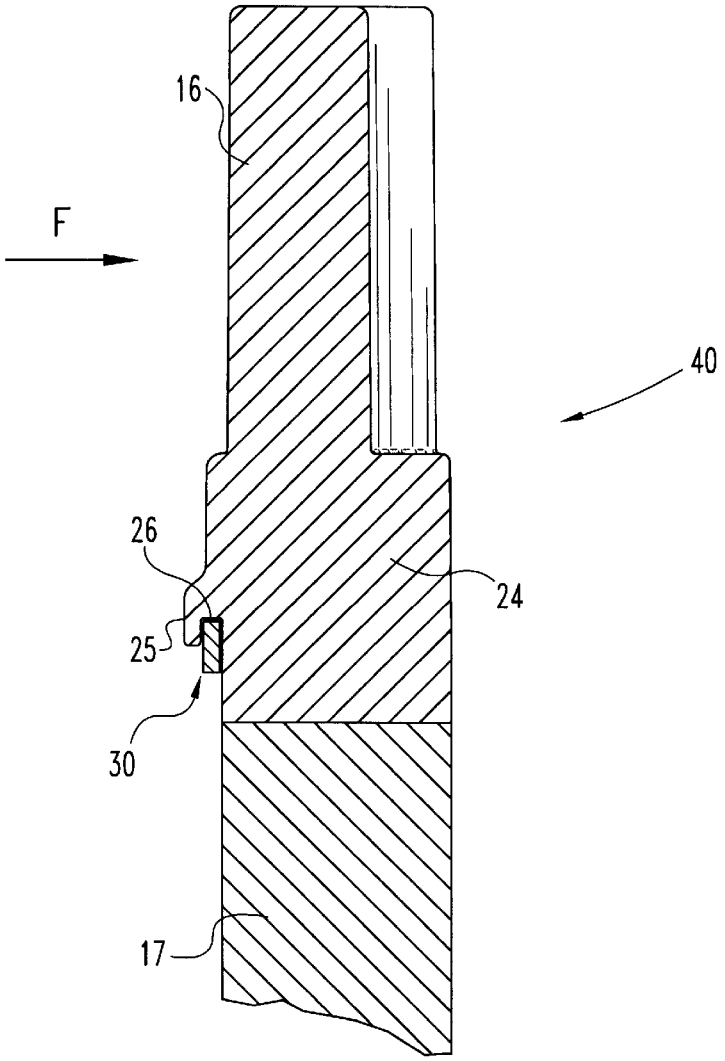
FIG. 4 is a sectional view taken along line 4—4 of FIG. 3 illustrating a retainer according to one form of the present invention.

Referring to FIGS. 3 and 4, there is illustrated a partial illustrative perspective view of the rotor assembly 40 with the plurality of blades 16 coupled thereto. Rotor assembly 40 is rotatable about a rotational center 20 and has an axis "L" extending radially through the rotational center 20. The rotor disk 17 includes a plurality of circumferentially spaced blade-receiving portions 23 for receiving a blade 16 therein. Each of the blade receiving portions 23 are defined by a pair of rotor disk members 22. The rotor disk members 22 are preferably integrally formed with the rotor disk 17. However, in an alternate embodiment the rotor disk members 22 define lugs that are bonded to the rotor disk 17.

Each of the blade receiving portions 23 interengage with an attachment portion 24 of the blade 16. More specifically, each of the attachment portions 24 cooperate with a blade-receiving portion 22 to couple one of the plurality of blades 16 with the disk 17. In one form each of the plurality of blades 16 is secured to the disk 17 with a dovetail type arrangement, however in another form of the present invention each of the plurality of blades 16 is secured to the disk 17 with a firtree type arrangement. Firtree and dovetail type blade attachment mechanisms are well known for their use in coupling blades to disks.

Figure 3A:
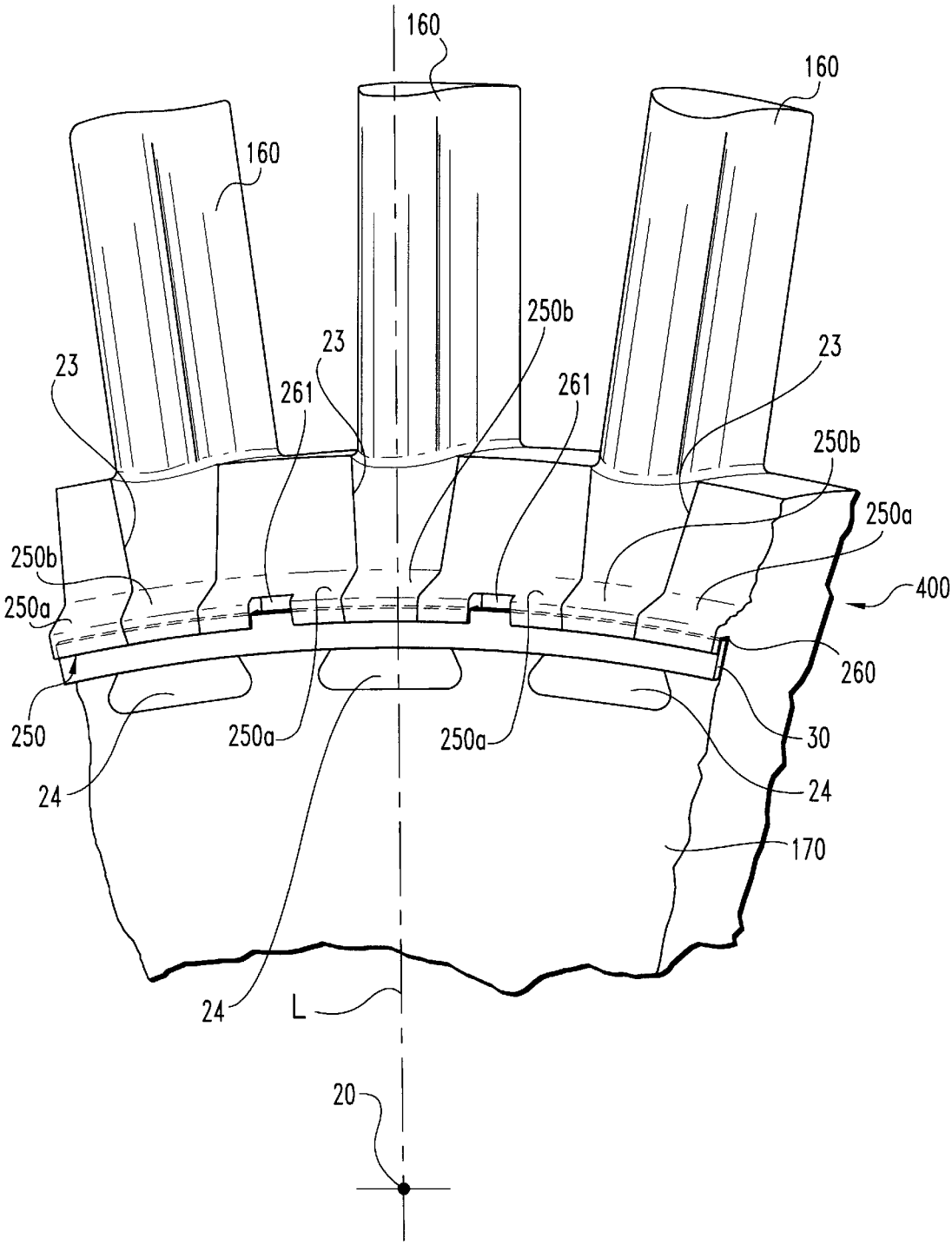
FIG. 3*a* is an illustrative partial side elevational view of an alternated embodiment of a rotor assembly comprising a portion of a gas turbine engine.

In one embodiment a retaining hook 25 includes a plurality of disk hooks 25*a* and a plurality of blade hooks 25*b*. The plurality of disk hooks 25*a* are formed on the disk 17 and each of the blades 16 has a blade hook 25*b* formed thereon. The retaining hook 25 defines a substantially continuous circumferential passageway 26 when the plurality of blades 16 is assembled to the disk 17. In one form of the present invention machining the rotor disk 17 and each of the plurality of blades 16 form the retaining hook 25. Other embodiments contemplate: a retaining hook defined by a plurality of disk hooks bonded to the rotor disk and each of the plurality of blades having a blade hook bonded thereto; or a plurality of disk hook casts to a near net shape with the disk and each of the plurality of blades has a blade hook cast to a near net shape therewith. In an alternate embodiment of the present invention illustrated in FIG. 3*a,* a retaining hook 250 is defined by a plurality of spaced arc shaped passageways 260 positioned around the periphery of the rotor disk 400. The retaining hook 250 includes a plurality of disk hooks 250*a* on the disk 170, and each of the plurality of blades 160 has a blade hook 250*b*. In the alternate embodiment the passageway 260 has spaced opening 261 formed therein. The remainder of rotor assembly 400 is substantially similar to rotor assembly 40.

The retaining hook 25 opens substantially radially inward toward the rotational center 20 of the rotor assembly 40. Retaining hook 25 is configured to receive retainer 30 therein, and to restrain the retainer 30 in the fore, aft and radial directions. The direction of fluid flow is indicated by arrow "F," with the fluid flowing from the fore side of rotor assembly 40 to the aft side. When retainer 30 is positioned within retaining hook 25, retainer 30 will simultaneously contact blade 16 and disk 17. Thus, retainer 30 cooperates with retaining hook 25 to resist the axial displacement of blade 16 in the fore and aft directions.

Figure 5:
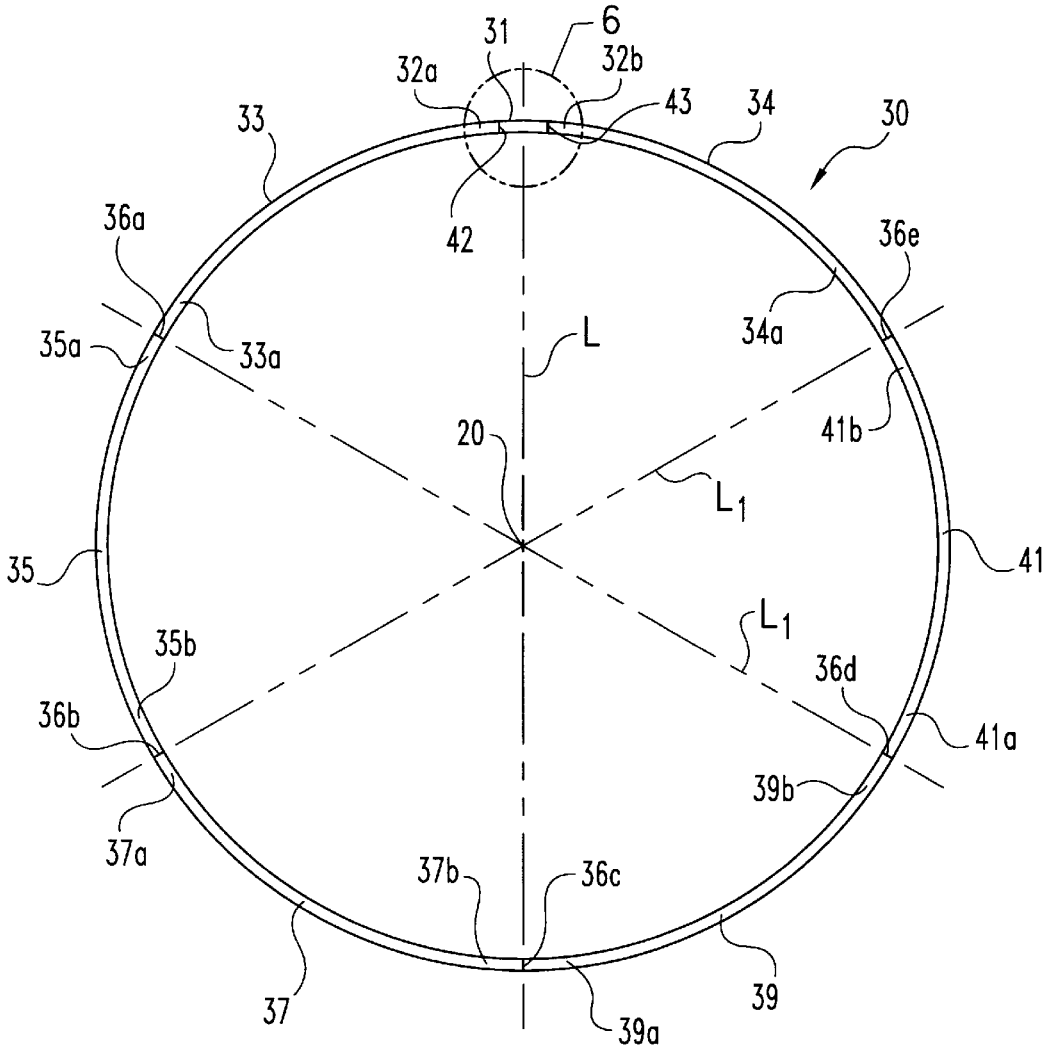
FIG. 5 is a plan view of the retainer comprising a portion of the FIG. 2 gas turbine engine.

Referring to FIG. 5, there is illustrated a plan view of the retainer 30 in an assembled configuration. For purposes of clarity, the retainer 30 is shown in an assembled state with the disk 17 and plurality of blades 16 removed. The rotational center 20 and axis "L" of the rotor disk assembly 40 are shown relative to retainer 30. In the preferred form of the present invention the axis "L" defines a radial axis. Additionally, radial axes "L1" are shown extending through the rotational center 20. The retainer 30 in the assembled state defines an annular ring positioned symmetrically about the rotational center 20. In one embodiment, retainer 30 includes a plurality of retaining segments 33, 34, 35, 37, 39, 41 and a locking segment 31. The adjacent retaining segments abut one another to form a radially extending joint 36*a,* 36*b,* 36*c,* 36*d,* 36*e,* which are collectively referred to as radial joints 36. More specifically, the radially extending joints are defined as follows: a radially extending joint 36*a* is defined where a second portion 33*a* of segment 33 abuts a first portion 35*a* of segment 35; a radially extending joint 36*b* is defined where a second portion 35*b* of segment 35 abuts a first portion 37*a* of segment 37; a radially extending joint 36*c* is defined where a second portion 37*b* of segment 37 abuts a first portion 39*a* of segment 39; a radially extending joint 36*d* is defined wherein a second portion 39*b* of segment 39 abuts a first portion 41*a* of segment 41; and, a radially extending joint 36*e* is defined where a second portion 41*b* of segment 41 abuts a second portion 34*a* of segment 34. Each of the radially extending joints 36 extend along a corresponding one of a plurality of radial axes "L1".

Minimizing the end gap between adjoining segments controls the inward radial displacement of the assembled retainer 30. As one of the plurality of retaining segments is displaced inward the end gap at the radial joint 36 is reduced or eliminated. When the end gap is eliminated the segment contacts the adjoining segment and further inward radial displacement is prevented.

Figure 6:
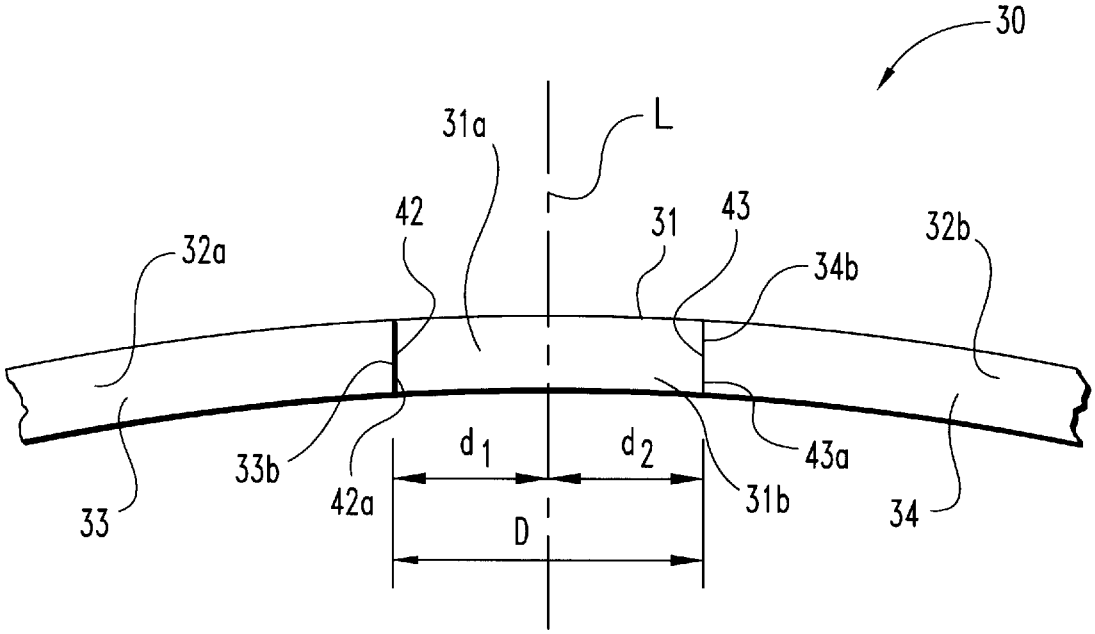
FIG. 6 is an enlarged partial plan view of the retainer of FIG. 5.

With reference to FIG. 6, there is illustrated a partial enlarged view of locking segment 31 and retaining segments 33 and 34. Locking segment 31 has a first portion 31*a* abutting a first portion 32*a* of segment 33 to define a joint 42 that extends parallel to the axis "L". Similarly, locking segment 31 has a second portion 31*b* abutting a second portion 32*b* of segment 34 to define a joint 43 that extends parallel to axis "L". The ends 42*a* and 43*a* of locking segment 31 are substantially parallel to one another. The joint 42 and 43 are each offset a distance 'd1' and 'd2,' respectively, from axis "L". In a preferred embodiment, d1 and d2 are substantially equal. Other embodiments contemplate distances d1 and d2 that are not substantially the same, so long as joints 42 and 43 are each substantially parallel to axis "L".

In one form of the present invention, retaining segments 33, 34 are designated as intermediate segments 33, 34. Each intermediate segment 33 and 34 forms a radially extending joint 36 at one end with an abutting retaining segment 35 and 41. The opposite other end 33*b* of intermediate segment 33 extend parallel to axis "L", and the opposite other end 34*b* extends parallel to axis "L". The ends 33*b* and 34*b* are offset a distance D and locking segment 31 may then be positioned therebetween.

Figure 7:
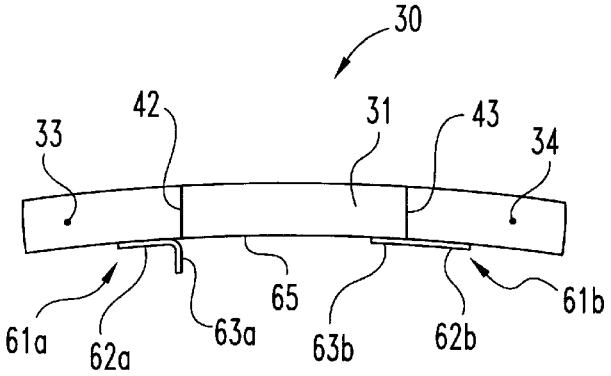
FIG. 7 is an enlarged partial plan view of the retainer of FIG. 5 with a pair of tabs coupled thereto.

One form of the present invention contemplates various mechanisms for minimizing and/or preventing displacement of the retainer 30 radially inward towards rotational center 20. Referring to FIG. 7, there is illustrated an enlarged view of locking segment 31 with one embodiment of the mechanism for preventing displacement of retainer 30. Tabs 61*a*, 61*b* are coupled to retaining segments 33, 34, respectively, via a pair of spaced engaging portions 62*a*, 62*b*. Opposite engaging portions 62*a*, 62*b* are deflecting portions 63*a*, 63*b*. Once locking segment 31 is in position to form joint 42 and joint 43, deflecting portions 63*a*, 63*b* may be deflected to engage a surface of locking segment 31 to prevent inward displacement of assembled retainer 30 towards center 20.

Figure 8:
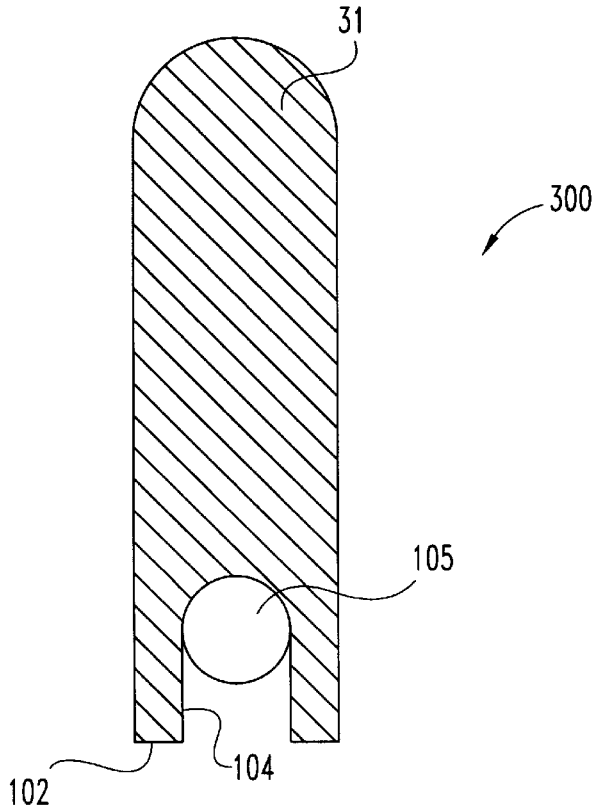
FIG. 8 is a cross-sectional view of an alternate embodiment retainer according to another form of the present invention.

Referring to FIG. 8, an alternate embodiment of a mechanism for resisting inward displacement of retainer 300 is illustrated. Retainer 300 is substantially similar to retainer 30 and each of the segments 31, 33, 34, 35, 37, 39, 41 include an inner surface 102 directed towards rotational center 20. A notch 104 is defined on the inner surface 102 and extends around the inner circumference of the retaining and locking segments. Notch 104 is configured to receive a wire 105 therein. The wire 105 is designed and constructed to bias the assembled retainer 300 into the retaining hook 25 defined by the disk and the plurality of blades and prevents the inward displacement of the retainer.

It should be understood that the present invention contemplates varying numbers of retaining segments. The retainer 30 has at least two retaining segments and in FIG. 5, there is illustrated one form of the retainer having six retaining segments and one locking segment. The retainer of the present invention could also have more than one locking segment 31.

The retainers of the present invention are assembled on the rotor assembly 40 by first placing the retaining segments 33, 34, 35, 37, 39, 41 within retaining hook 25. Thereafter, the locking segment 31 is inserted between the segments 33 and 34 to complete the retainer 30. Once assembled, locking segment 31 maintains retainer 30 in position within retaining hook 25. The tabs 61 are deflected or wire 105 is inserted, if desired, to prevent inward displacement of retainer 30.

The present invention allows retainer 30 to be assembled within the retaining hook with little or no deflection of the segments, thereby allowing the utilization of low ductility materials for the segments. Preferably the materials have a high temperature resistance and/or low density, and include but are not limited to materials such as titanium-aluminide and ceramic materials. The relatively low density of the materials reduces the weight of the retainer. However, it should be understood the present invention contemplates the use of virtually any material for retainer 30 that is acceptable for use in gas turbine engines, such as but not limited to nickel or steel.

While the invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protective.

What is claimed is:

1. A retainer comprising:

a plurality of retaining segments abutting one another and defining a first end and a second end spaced a first distance therefrom; and a locking segment having a third end and a forth end that are substantially parallel to one another, said locking segment positioned between said first end and said second end, and at least one of said third end and said fourth end abutting at least one of said first end and said second end.

2. The retainer of claim 1, wherein the retainer includes a center and an axis extending through the center, and wherein said first end and said second end extending substantially parallel to the axis.

3. The retainer of claim 2, wherein said axis defines a radial axis, and wherein said first end is spaced a second distance from the axis, and wherein the second end is spaced a third distance from the axis.

4. The retainer of claim 3, wherein said second distance and said third distance are equal.

5. The retainer of claim 2, wherein a notch is formed in an underside of said segments, and which further includes a member disposed within said notch and adapted to resist movement of the segments towards said center.

6. The retainer of claim 2, which further includes at least one tab extending between said locking segment and at least an adjacent one of said plurality of retaining segments.

7. The retainer of claim 2, wherein the plurality of retaining segments includes a first intermediate segment having one end defining the first end and a second intermediate segment having one end defining the second end.

8. The retainer of claim 7, wherein:

the remaining retaining segments define radially extending joints at the interface between adjacent retaining segments; and wherein the other end of each of said intermediate segments defines a radially extending joint at the interface with one of said remaining retaining segments.

9. The retainer of claim 8, wherein the retainer is formed of a titanium-aluminide material.

10. The retainer of claim 8, wherein the retainer is formed of a ceramic material.

11. The retainer of claim 2, wherein said third end abutting one of said first end and said second end, and said fourth end abutting the other of said first end and said second end.

12. An apparatus comprising:

a gas turbine engine rotor disk having a centerline;

a plurality of blades coupled to said rotor disk;

a passageway disposed along the rotor disk;

a retainer received within said passageway, said retainer engaging said plurality of blades and said disk, wherein said retainer, includes:

a plurality of abutting retaining segments defining a first end and a second end spaced a first distance;

a locking segment positioned between said first and second ends and engaging at least one of said first and second ends; and at least one member extending between the locking segment and at least one of the plurality of abutting retaining segments, said at least one member preventing displacement of the locking segment retainer towards the centerline.

13. The apparatus of claim 12, wherein said locking segment and said plurality of retaining segments each include a notch formed in an inner surface thereof, and wherein said at least one member is disposed within said notch.

14. The apparatus of claim 13, wherein said at least one member defines a wire.

15. The apparatus of claim 12, wherein said at least one member includes at least one tab extending between said locking segment and at least one of said plurality of retaining segments.

16. The apparatus of claim 12, wherein said at least one member defines a pair of members, each of said pair of members including at least one tab extending between said locking segment and a retaining segment.

17. The apparatus of claim 12, wherein said passageway is continuous, and wherein said passageway is defined by a retaining hook.

18. The apparatus of claim 12, wherein said retainer defines a center and an axis extending through said center, and wherein said first and second ends extending substantially parallel to said axis.

19. The apparatus of claim 17, wherein said ends are each spaced a second distance from the axis.

20. A method for resisting axial displacement of a plurality of blades of a rotor disk assembly of a gas turbine engine, the rotor disk assembly defining a center and an axis extending therethrough and including a retaining hook, the method comprising:

providing a segmented retainer, the segmented retainer including a plurality of retaining segments and at least one locking segment;

placing the plurality of retaining segments in the retaining hook, the retaining segments defining a first end and a second end, each offset a distance from and parallel to the axis;

inserting a locking segment between the first end and the second end; and preventing displacent of the retainer towards the center of the rotor disk assembly after said inserting.

21. A retainer, comprising:

a plurality of retaining segments abutting one another and defining a first end and a second end spaced a distance therefrom;

a locking segment positioned between said first end and said second end, said locking segment having a third end abutting said first end and a fourth end abutting said second end, said plurality of retaining segments and said locking segment defining a substantially ring shape and having a center; and at least one member extending between said locking segment and at least one of said plurality of retaining segments to minimize the displacement of said locking segment towards said center.

22. The retainer of claim 21, wherein said plurality of retaining segments and said locking segment are formed of a low density high temperature capable material.

23. The retainer of claim 21, wherein said plurality of retaining segments and said locking segment is formed of one of a titanium aluminide material and a ceramic material.

24. The retainer of claim 21, wherein said at least one member includes a wire.

25. The retainer of claim 24, wherein said plurality of retaining segments and said locking segment include a groove formed therein and adapted to receive at least a portion of said wire therein.

26. The retainer of claim 21, wherein said at least one member includes a first tab connecting between said locking segment and said first end and a second tab connecting between said locking segment and said second end.

* * * * *